US008061373B1

(12) United States Patent
Storms

(10) Patent No.: US 8,061,373 B1
(45) Date of Patent: Nov. 22, 2011

(54) SURFACE CLEANING APPARATUS

(76) Inventor: John R. Storms, Boca Raton, FL (US)

( * ) Notice: Subject to any disclaimer, the term of this patent is extended or adjusted under 35 U.S.C. 154(b) by 588 days.

(21) Appl. No.: 12/248,701

(22) Filed: Oct. 9, 2008

(51) Int. Cl.
*B08B 3/00* (2006.01)
*B08B 3/12* (2006.01)
*B08B 6/00* (2006.01)

(52) U.S. Cl. ..... 134/174; 134/172; 134/173; 134/176; 134/179; 134/180

(58) Field of Classification Search ..... 134/172–174, 134/176, 179–180
See application file for complete search history.

(56) References Cited

U.S. PATENT DOCUMENTS 3,726,481 A 4/1973 Foster et al.
3,848,804 A * 11/1974 Prestwich ..... 239/160
4,168,562 A 9/1979 Maasberg
4,377,018 A 3/1983 Cain
4,753,549 A * 6/1988 Shook et al. ..... 404/75
5,004,156 A * 4/1991 Montanier ..... 239/130
5,455,985 A * 10/1995 Hamline et al. ..... 15/401
5,456,412 A 10/1995 Agee
5,463,791 A 11/1995 Roden
D375,591 S 11/1996 Fryoux
6,378,163 B1 4/2002 Moll et al.
7,238,243 B2 7/2007 Brantley et al.

* cited by examiner

*Primary Examiner* — Michael Barr
*Assistant Examiner* — Charles W Kling
(74) *Attorney, Agent, or Firm* — Crossley Patent Law; Mark A. Crossley

(57) ABSTRACT

The surface cleaning apparatus is provided in self-propelled embodiments and in a trailer embodiment. The apparatus draws liquid from a supplied tank. Liquid is pressurized to approximately 4,000 psi, then directly to the surface to be cleaned. All cleaning and cleaning component functions are powered via the same fluid pumps via a supply manifold. Total width limitations dictated the design of the sidewalk capable apparatus.

1 Claim, 8 Drawing Sheets

SURFACE CLEANING APPARATUS

BACKGROUND OF THE INVENTION

Cleaning sidewalks and other narrow areas, especially those paved, has typically been done by limited equipment which requires a plurality of workers simultaneously occupied in cleaning efforts. Labor costs are therefore significant. The equipment typically involved is not sized for sidewalks and the like, but is instead designed for much larger areas. For this reason, traffic is often stopped or rerouted in order for such surfaces to be cleaned. Also, due to these problems, such surfaces are not often cleaned as thoroughly or as often as might be recommended. What is needed is a sidewalk cleaning apparatus that can be operated by one individual. What is further needed is repetitive cleaning mechanisms that overlap in order to assure cleanliness. A further desirable feature is sufficient liquid pressure to insure proper cleaning. The present apparatus provides these advantages.

The present apparatus further provides adjustable height cleaning components and spring loaded housings which move inwardly upon impact with extraneous objects.

FIELD OF THE INVENTION

The surface cleaning apparatus relates to devices for cleaning surfaces, and more especially to a surface cleaning apparatus controllable by one individual and designed to thoroughly clean narrow surfaces such as sidewalks, with repetitive, overlapping height adjustable high pressure liquid spray.

SUMMARY OF THE INVENTION

The general purpose of the surface cleaning apparatus, described subsequently in greater detail, is to provide a surface cleaning apparatus which has many novel features that result in an improved surface cleaning apparatus which is not anticipated, rendered obvious, suggested, or even implied by prior art, either alone or in combination thereof.

To attain this, the surface cleaning apparatus is provided in more than one embodiment. The apparatus is a pressure washing machine for cleaning sidewalks and related areas. An important feature of the apparatus is that the experimentally derived design provides for an overall width no greater than six feet. This width limitation provides effective cleaning of sidewalks and the like, by one individual, where previous cleaning devices have failed in meeting such needs.

One embodiment comprises a self-powered vehicle which acquires water from a separate source. A water tank is each an excellent example of such a separate water source.

The vehicle is also equipped with a hitch for towing a mobile liquid storage trailer. Another embodiment of the apparatus includes the liquid storage trailer. The most complete embodiment of the apparatus features at least three rotary pressure cleaning units within rotary housings. The housings are supported by a plurality of casters and are attached to the underside of the varied embodiments in somewhat the style of traditional mowing decks. Two of the rotary housings are disposed outside of either side of the centerline and feature a reactive width capability from spring-loaded design. Should either of the side-by-side rotary housings collide with an extraneous object, each housing is capable of separate inward movement, then automatic rebound upon ceased contact with the object. This feature is important in considering usage around park benches, street and traffic equipment, and a host other objects that would otherwise typically require the use of multiple workers and various machinery combinations. Highly pressurized water can be supplied by single or multiple pumps, depending upon the apparatus embodiment.

An added and important feature of the rotary housings is that each is height adjustable. A further feature of benefit is the hose reel with wand, whereby an individual can address specific areas not cleaned or cleaned sufficiently by the rotating pipes with jets within the rotary housings.

Appealing features of the present sidewalk pressure cleaning device are its speed, efficiency, and effectiveness. The present device provides a fast and efficient means of removing accumulated dirt, motor oil, chewing gum, and related residue from sidewalks, lots, and related areas. The present device is easy to operate and may be employed on most types of concrete, asphalt, and related materials.

Thus has been broadly outlined the more important features of the improved surface cleaning apparatus so that the detailed description thereof that follows may be better understood and in order that the present contribution to the art may be better appreciated.

An object of the surface cleaning apparatus is to provide for a single operator to clean sidewalks and other relatively narrow surfaces.

Another object of the surface cleaning apparatus is to provide inward and rebound movement of each rearward rotary housing upon impact with an extraneous object.

A further object of the surface cleaning apparatus is to provide sufficient liquid pressure to be highly effective in cleaning the above referenced surfaces.

Yet another object of the surface cleaning apparatus is to provide for inward and subsequent outward rebound of at least one rotary housing.

And still another object of the surface cleaning apparatus is to provide these advantages and others in a total width no greater than six feet.

These together with additional objects, features and advantages of the improved surface cleaning apparatus will be readily apparent to those of ordinary skill in the art upon reading the following detailed description of presently preferred, but nonetheless illustrative, embodiments of the improved surface cleaning apparatus when taken in conjunction with the accompanying drawings.

In this respect, before explaining the current embodiments of the improved surface cleaning apparatus in detail, it is to be understood that the surface cleaning apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved surface cleaning apparatus. It is therefore important that the claims be regarded as including such equivalent constructions insofar as they do not depart from the spirit and scope of the surface cleaning apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 9 thereof, the principles and concepts of the surface cleaning apparatus generally designated by the reference number 10 will be described.

Figure 1:
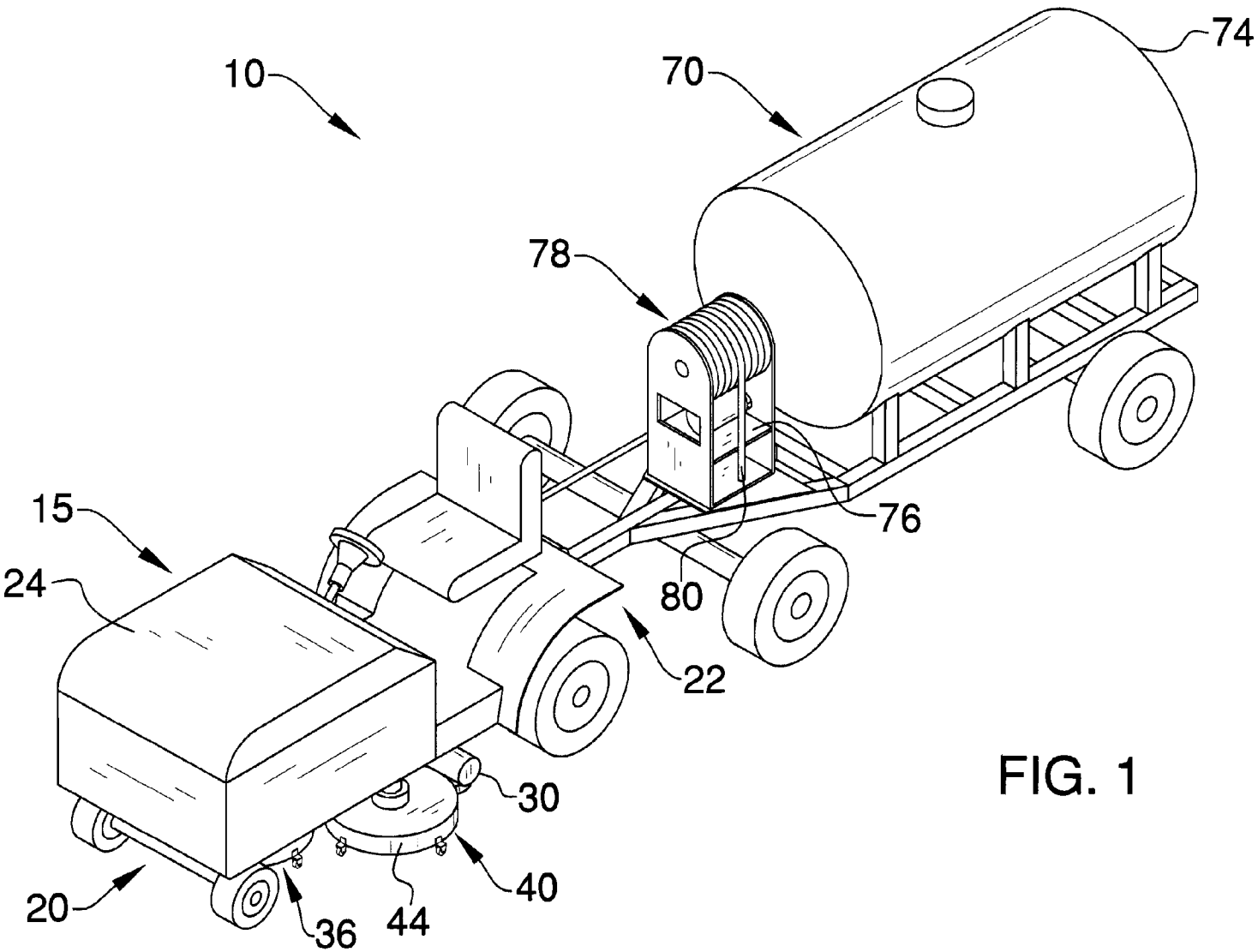
FIG. 1 is a perspective view.
Figure 2:
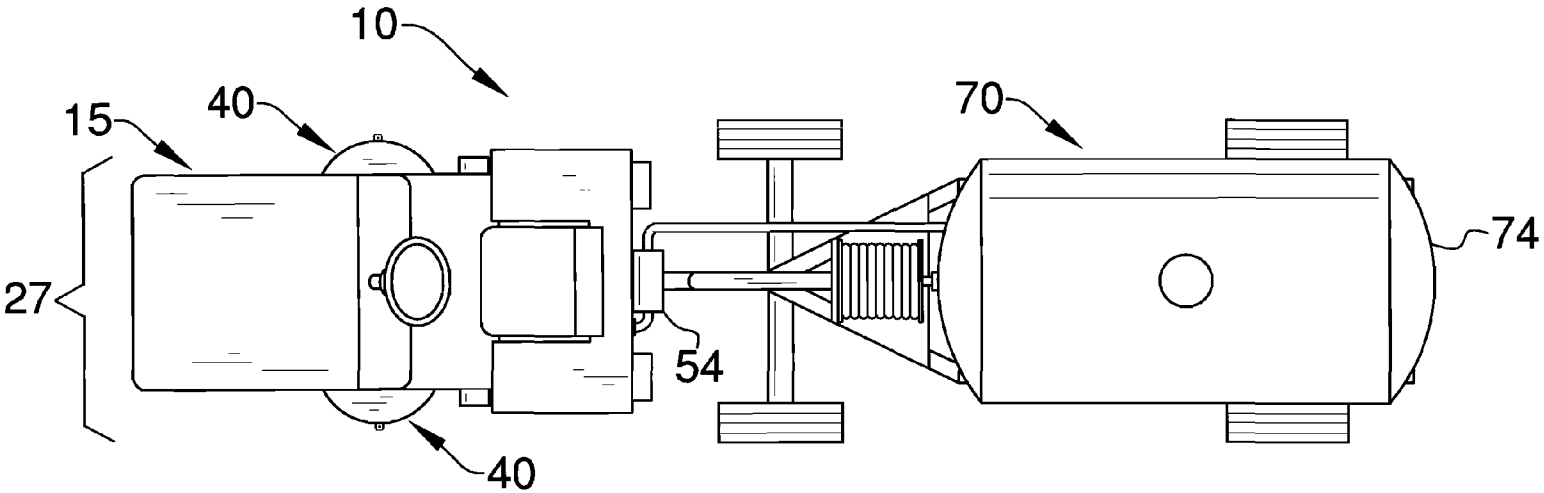
FIG. 2 is a top plan view.
Figure 3:
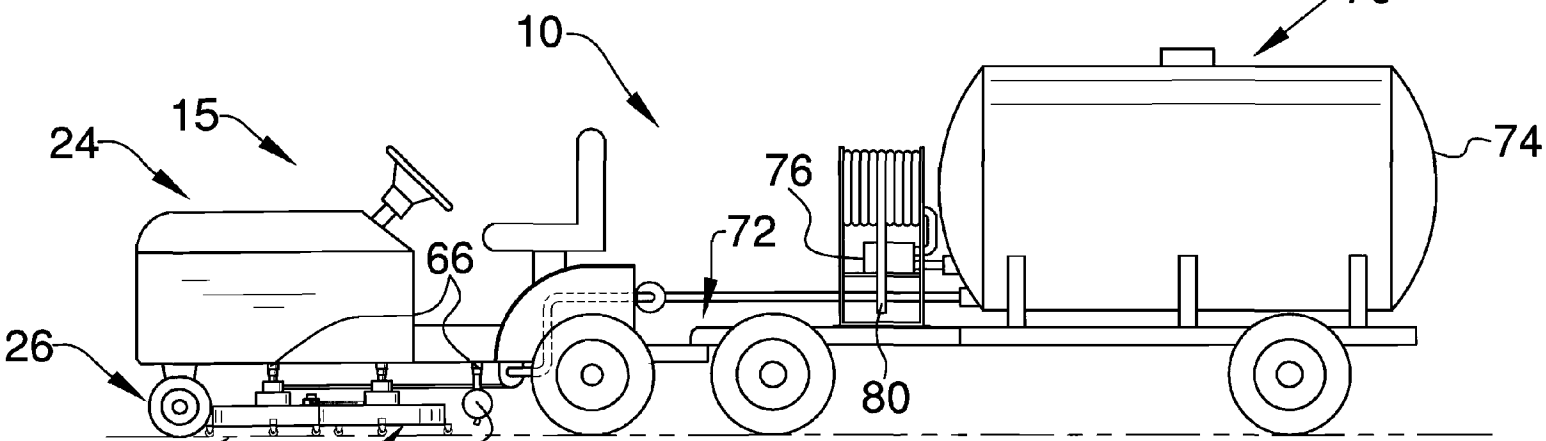
FIG. 3 is a side elevation view.

Referring to FIGS. 1, 2, and 3, the surface cleaning apparatus 10, comprises, in combination, a mobile liquid storage trailer 70 which has a liquid storage tank 74. The trailer 70 further comprises a hose reel 78 in communication with the tank pump 76. The selectively operated wand 80 is disposed on the end of the hose reel 78. The trailer 70 is selectively coupled to the self-propelled vehicle 15 via the hitch 72. The tank pump 76 provides pressurized liquid from the tank 74. The vehicle 15 has a front 20, a rear 22, a top 24, a bottom 26, and a width 27 no greater than six feet. The overall width 27 of the vehicle 15 is important in providing for cleaning of sidewalks and other narrow surfaces which do not tolerate any greater overall width 27. The vehicle 15 further comprises the vehicle pump 54 which further pressurizes liquid received from the tank pump 76.

Figure 4:
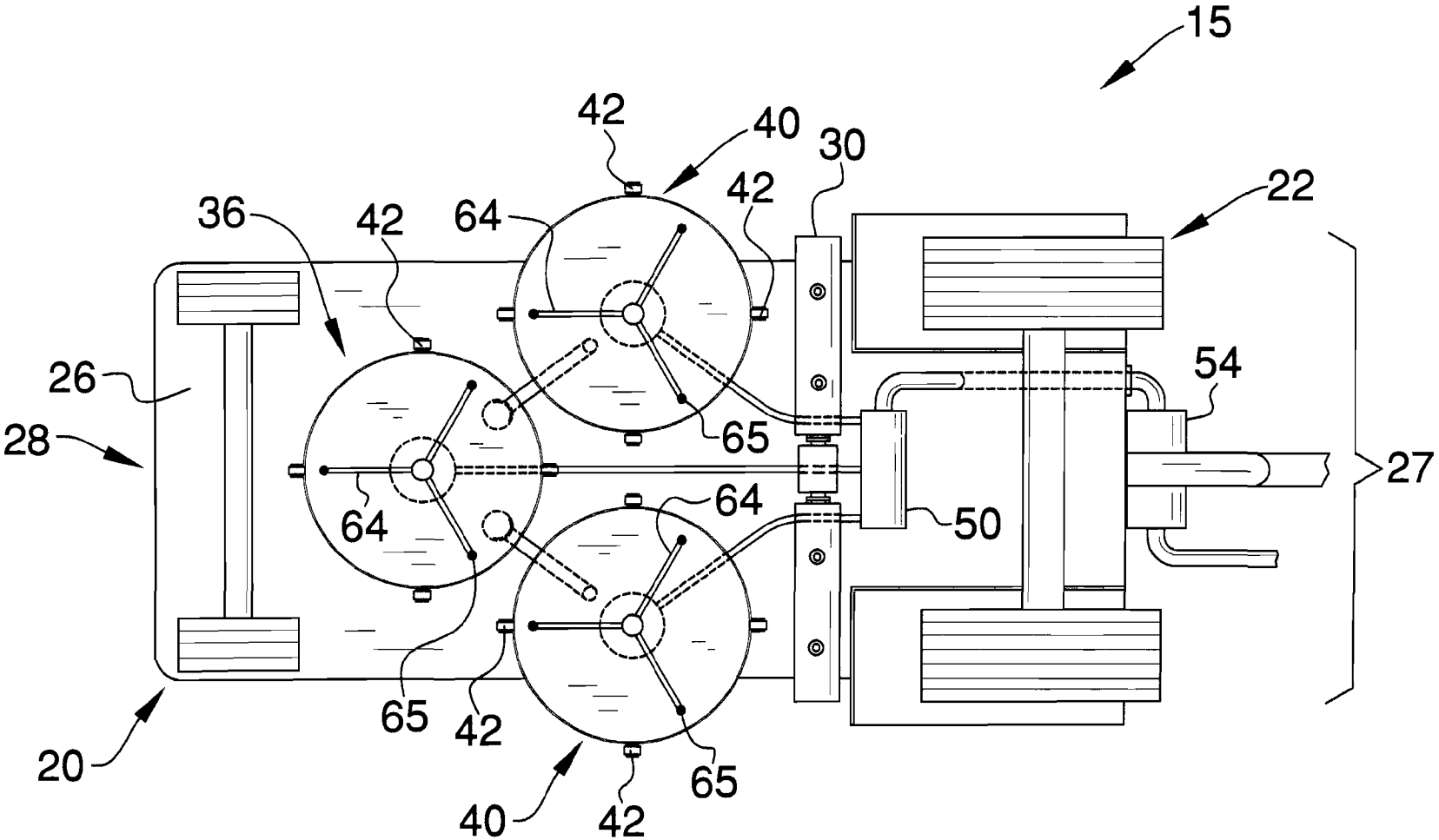
FIG. 4 is a bottom plan view of the vehicle.
Figure 5:
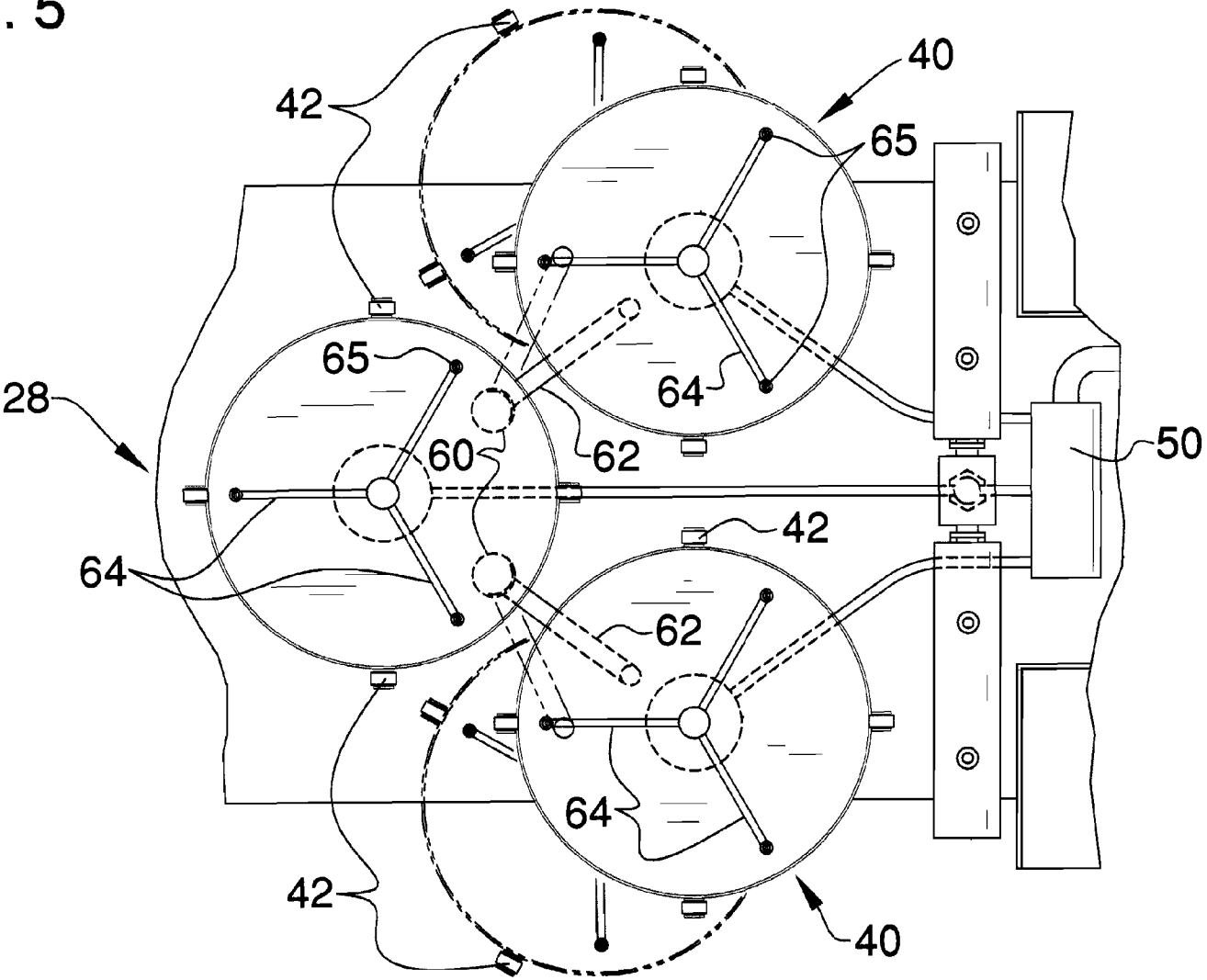
FIG. 5 is a bottom plan view of part of the vehicle, illustrating inward and outward movement of the rearward rotary housings.
Figure 6:
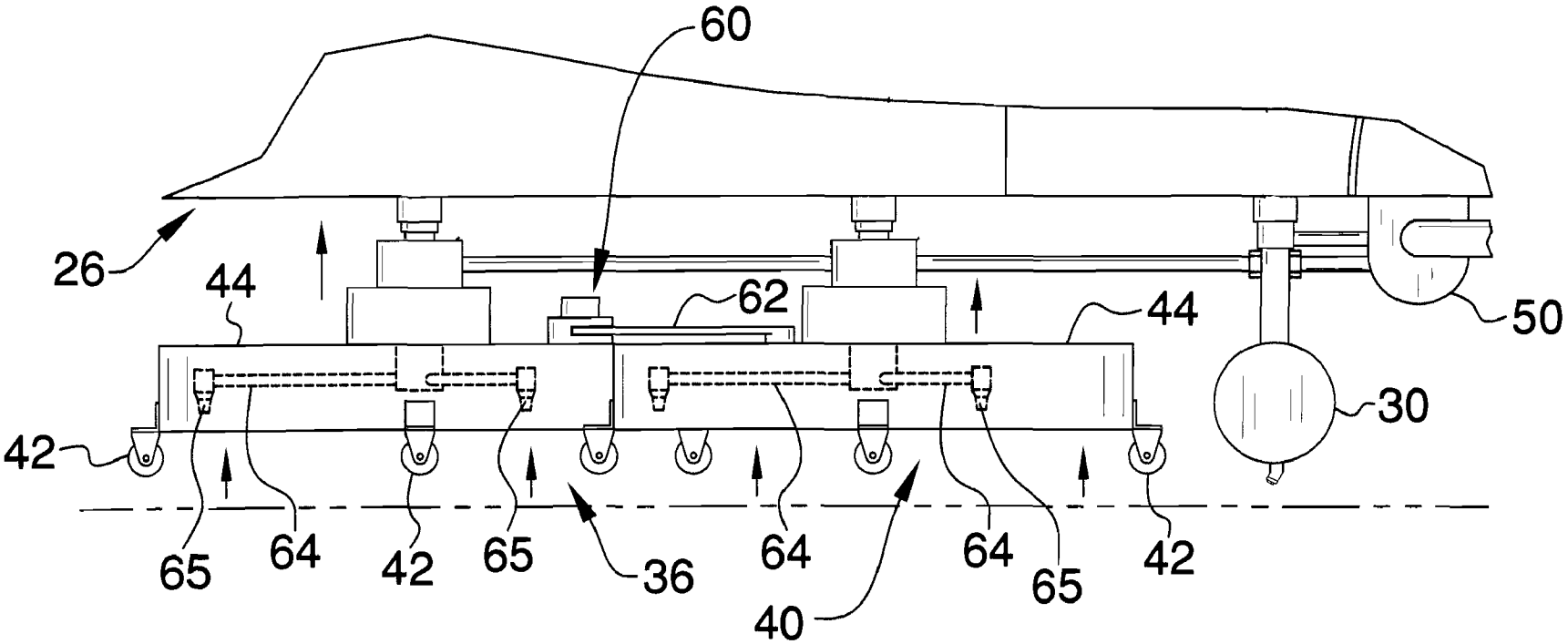
FIG. 6 is a side elevation view of part of the bottom of the vehicle, illustrating rotary housing and roller sweeper lift capabilities.

Further referring to FIGS. 1-3 and also to FIGS. 4-6, the vehicle 15 further comprises the supply manifold 50 which is in communication with the vehicle pump 54. The design featuring the combined tank pump 76, vehicle pump 54, and supply manifold 50 is important in that it provides a continuous minimum 4,000 psi of liquid pressure. The coaxial elongated roller sweepers 30 are disposed on the bottom 26 of the vehicle 15. The forward rotary housing 36 is disposed on the bottom 26 and proximal to the front 20 of the vehicle 15. The forward rotary housing 36 is disposed centrally to the centerline 28 of the vehicle 15. The forward rotary housing 36 has a circular outer border 44. The pair of spaced apart rearward rotary housings 40 is disposed between the forward rotary housing 36 and the roller sweeper 30 and is arranged side-by-side. Each rearward rotary housing 40 is disposed outside the centerline 28 of the vehicle 15. Each rearward rotary housing 40 has a circular outer border 44. A plurality of spaced apart casters 42 is disposed on the bottom of each outer border 44. The trio of rotating delivery pipes 64 is equidistantly radiated from a center of each rearward rotary housing 40 and from the forward rotary housing 36. Each trio of pipes 64 is in communication with the vehicle pump 54 via the supply manifold 50. A liquid spray jet 65 faces downwardly on the outer end of each pipe 64.

The pair of spaced apart pivots 60 is affixed to the top of the forward rotary housing 36. A spring loaded arm 62 is affixed to the top of each rearward rotary housing 40. Each arm 62 is further affixed to one of the pivots 60 of the forward rotary housing 36, respectively. Inward and subsequent outward rebound movement of either of the rearward rotary housings 40 is provided upon border 44 impact with an extraneous object.

Figure 7:
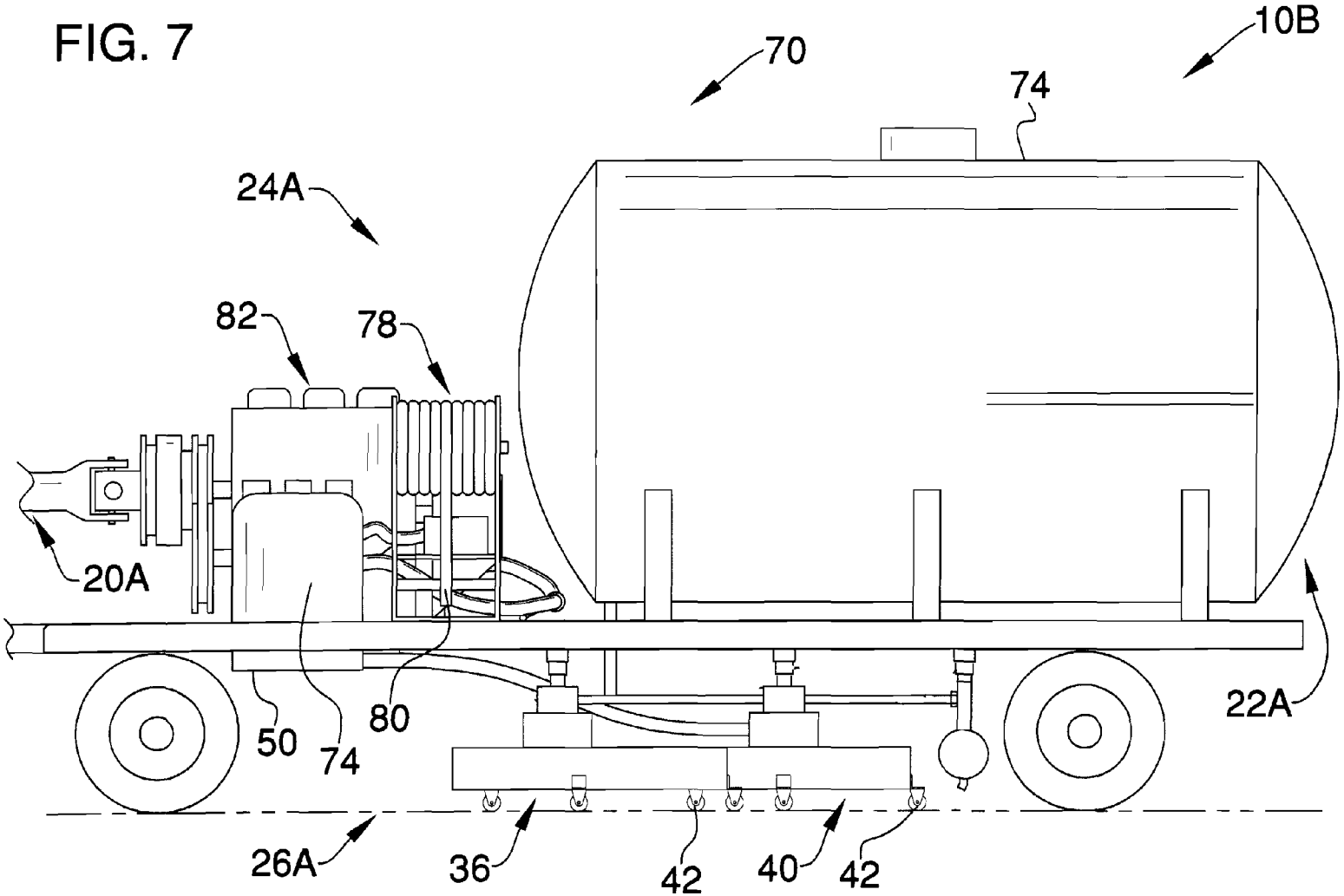
FIG. 7 is a side elevation view of an alternate embodiment of the apparatus.
Figure 8:
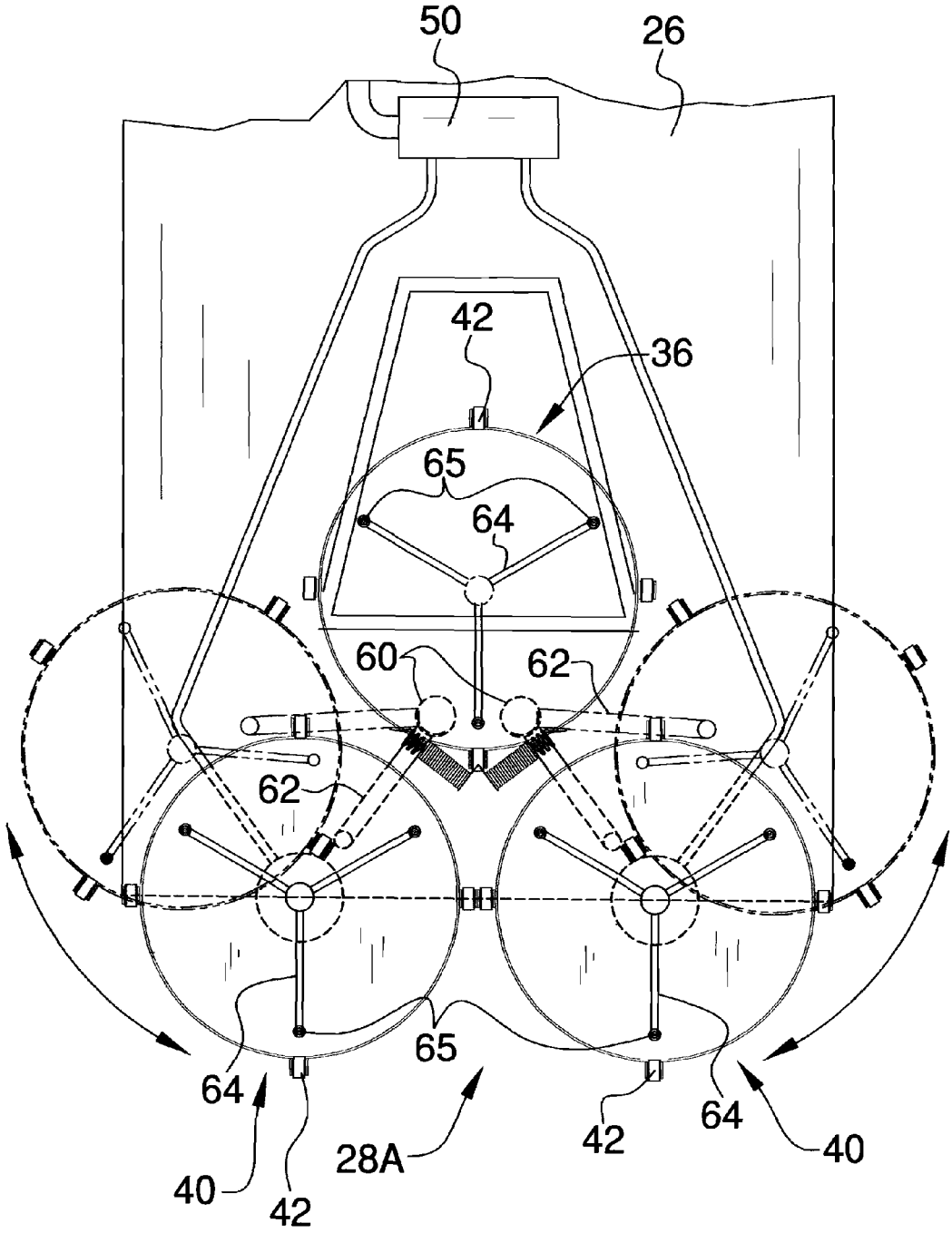
FIG. 8 is a partial bottom plan view of the alternate embodiment of FIG. 7.
Figure 9:
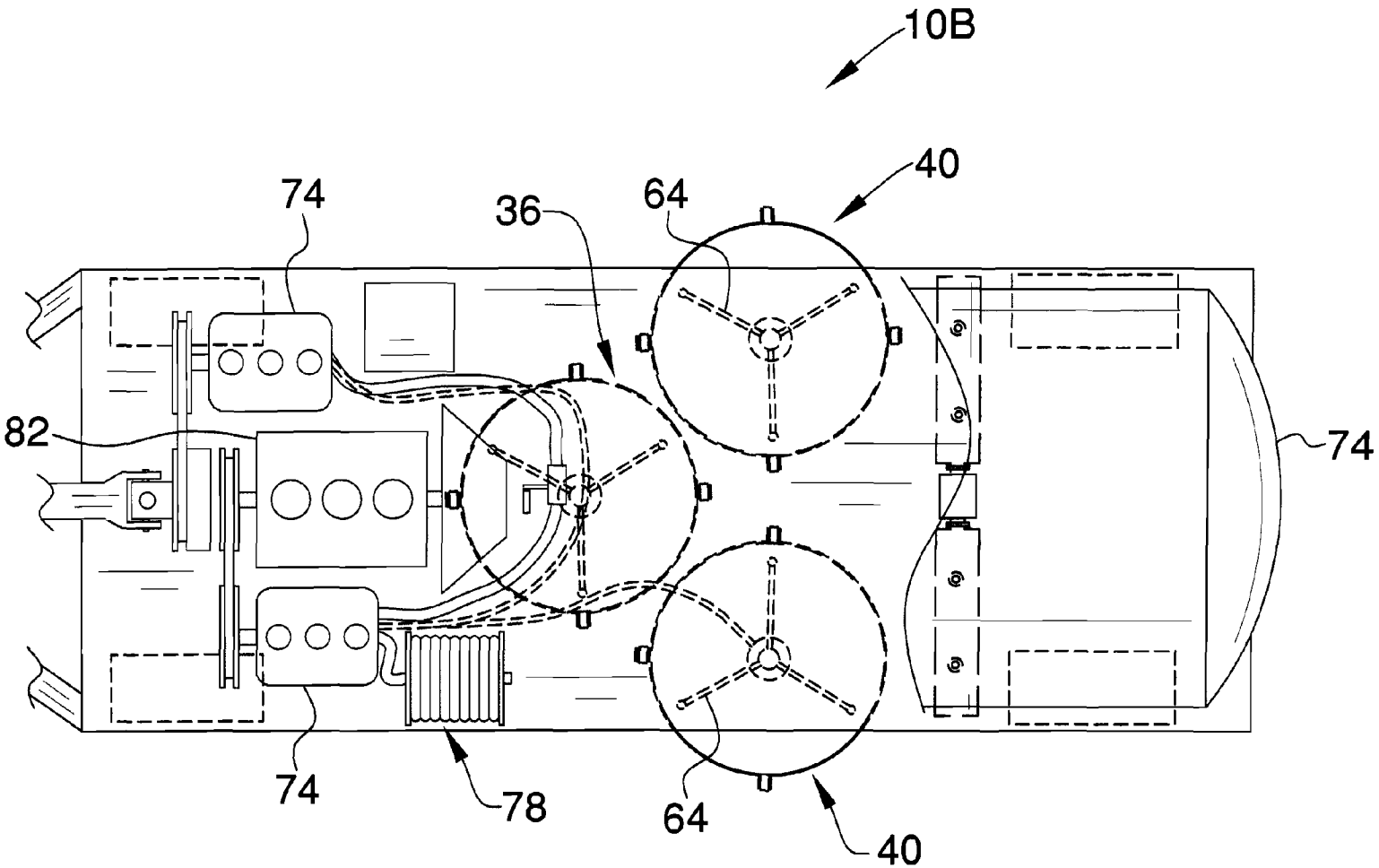
FIG. 9 is a partial cutaway top plan view of the embodiment of FIGS. 7 and 8.

Referring to FIGS. 7-9, the alternate embodiment of the apparatus 10B comprises the mobile liquid storage trailer 70. The trailer 70 has a front 20*a*, a rear 22*a*, a bottom 26*a*, and a top 24*a*. The liquid storage tank 74 is disposed on the trailer 70 top 24*a*. The engine 82 is disposed on the top 24*a*. A pair of spaced apart tank pumps 76 is disposed on the trailer 70 top 24*a* and is in communication with the engine 82. The tank pumps 76 deliver pressurized liquid from the tank 74. The tank pumps 76 supply the supply manifold 50. The hose reel 78 is in communication with one tank pump 76. The selectively operated wand 80 is disposed the end of the hose reel 78. The supply manifold 50 is in communication with the tank pumps 76, whereby the combined tank pumps 76 and supply manifold 50 provide a continuous minimum 4,000 psi of liquid pressure. The forward rotary housing 36 is disposed on the bottom 26*a* and proximal to the front 20*a* of the trailer 70. The forward rotary housing 36 is disposed centrally to the centerline 28*a* of the trailer 70. The forward rotary housing 36 has a circular outer border 44. The pair of spaced apart rearward rotary housings 40 is disposed behind the forward rotary housing 36.

Each rearward rotary housing 40 is disposed outside the centerline 28*a* of the trailer 70. Each rearward rotary housing 40 has a circular outer border 44. A trio of rotating delivery pipes 64 is equidistantly radiated from a center of each rearward rotary housing 40 and the forward rotary housing 36. Each trio of pipes 64 is in communication with the supply manifold 50. A liquid spray jet 65 is disposed on an end of each pipe 64. A plurality of spaced apart casters 42 is disposed on the bottom of each housing circular outer border 44. The pair of spaced apart pivots 60 is affixed to a top of the forward rotary housing 36. A spring loaded arm 62 is affixed to a top of each rearward rotary housing 40. Each arm 62 is further affixed to one of the pivots 60 of the forward rotary housing 36, respectively. Thereby, inward and subsequent outward rebound movement of either of the rearward rotary housings 40 is provided upon border 44 impact with an extraneous object.

With respect to the above description then, it is to be realized that the optimum dimensional relationships for the parts of the surface cleaning apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the surface cleaning apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the surface cleaning apparatus may be used.

Therefore, the foregoing is considered as illustrative only of the principles of the surface cleaning apparatus. Further, since numerous modifications and changes will readily occur to those skilled in the art, it is not desired to limit the surface cleaning apparatus to the exact construction and operation shown and described, and accordingly, all suitable modifications and equivalents may be resorted to, falling within the scope of the surface cleaning apparatus.

What is claimed is:

1. A surface cleaning apparatus, comprising, in combination:

a mobile liquid storage trailer having a tank, at least one tank pump delivering pressurized liquid from the tank;

a hose reel in communication with the tank pump;

a selectively operated wand on an end of the hose reel;

a self-propelled vehicle selectively coupled to the trailer, the vehicle having a front, a rear, a top, a bottom, and a width no greater than six feet, the vehicle further comprising:

a vehicle pump further pressurizing liquid received from the tank pump;

a supply manifold in communication with the vehicle pump, whereby the combined tank pump, vehicle pump, and supply manifold provide a continuous minimum 4,000 psi of liquid pressure;

a forward rotary housing on the bottom of and proximal to the front of the vehicle, the forward rotary housing disposed centrally to a centerline of the vehicle, the forward rotary housing having a circular outer border;

a pair of spaced apart rearward rotary housings disposed behind the forward rotary housing, each rearward rotary housing disposed outside the centerline of the vehicle, each rearward rotary housing having a circular outer border;

a trio of rotating delivery pipes equidistantly radiated from a center of each rotary housing, each trio in communication with the manifold;

a liquid spray jet on an end of each delivery pipe;

a plurality of spaced apart casters on a bottom of each housing outer border;

a pair of spaced apart pivots affixed to a top of the forward rotary housing;

a spring loaded arm affixed to a top of each rearward rotary housing, each arm further affixed to one of the pivots of the forward rotary housing, respectively;

whereby inward and subsequent outward rebound movement of either of the rearward rotary housings is provided upon border impact with an extraneous object.

* * * * *